US005528476A

United States Patent [19]

Fenton

[11] Patent Number: 5,528,476

[45] Date of Patent: Jun. 18, 1996

[54] LIGHTING APPARATUS FOR USE ON KITES

[76] Inventor: Barry E. Fenton, 34735 181st Ave. SE., Auburn, Wash. 98092

[21] Appl. No.: 385,971

[22] Filed: Feb. 9, 1995

[51] Int. Cl.[6] ..... A63H 27/08

[52] U.S. Cl. ..... 362/249; 362/800; 362/806; 362/253; 362/234; 244/155 R

[58] Field of Search ..... 362/234, 235, 362/237, 240, 219, 249, 252, 800, 806, 253; 244/155 R, 153 R; 446/47, 485

[56] References Cited

U.S. PATENT DOCUMENTS

| | | | |
|---|---|---|---|
| 3,692,993 | 9/1972 | Robinson | 362/249 X |
| 4,308,572 | 12/1981 | Davidson et al. | 362/103 |
| 4,514,791 | 4/1985 | Tokieda | 362/249 |
| 4,942,506 | 7/1990 | Flory | 362/253 |
| 5,000,402 | 3/1991 | Blackburn | 362/802 X |
| 5,410,458 | 4/1995 | Bell | 362/240 X |

*Primary Examiner*—Denise L. Gromada
*Assistant Examiner*—Thomas M. Sember
*Attorney, Agent, or Firm*—Robert W. Jenny

[57] ABSTRACT

The apparatus is made up of a battery pack, two two-wire conductors, a plurality of light emitting diodes, a plurality of clips and a terminal board. The battery pack is made up of (1) a battery holder, including conductors to connect the batteries in series and deliver power to two terminals on the end of the holder, (2) a heat shrunk tube enclosing the connections of the two wires in each conductor to resistors which limit the power delivered to the diodes and connections of the resistors to two conductors connected to the terminals on the terminal board. Some of the plurality of LED's are attached at points along one two-wire conductor to the wires in the conductor; the remainder is similarly attached to the other two-wire conductor. There is a Velcro (T.M.) fitted strap attached to the holder and used to fasten the pack to kite structure. An elastromeric tube is also attached to the holder to provide friction to keep the battery pack from inadvertently sliding on the structure to which it is strapped. Each clip is detachably attached to an LED and holds the LED and adjacent conductor to kite structure. Power to the LED's is switched on and off by connecting and disconnecting the terminals on the terminal board to those on the holder.

2 Claims, 1 Drawing Sheet

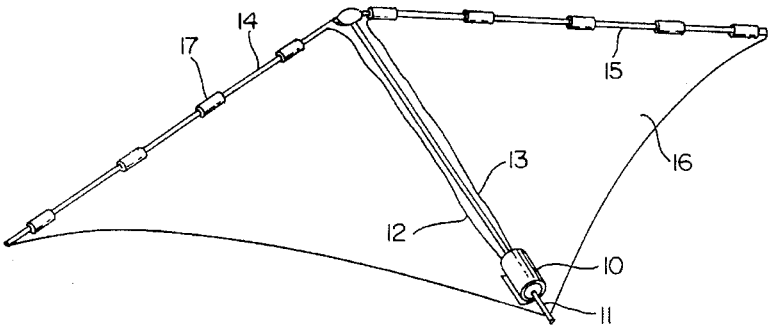
FIG. 1
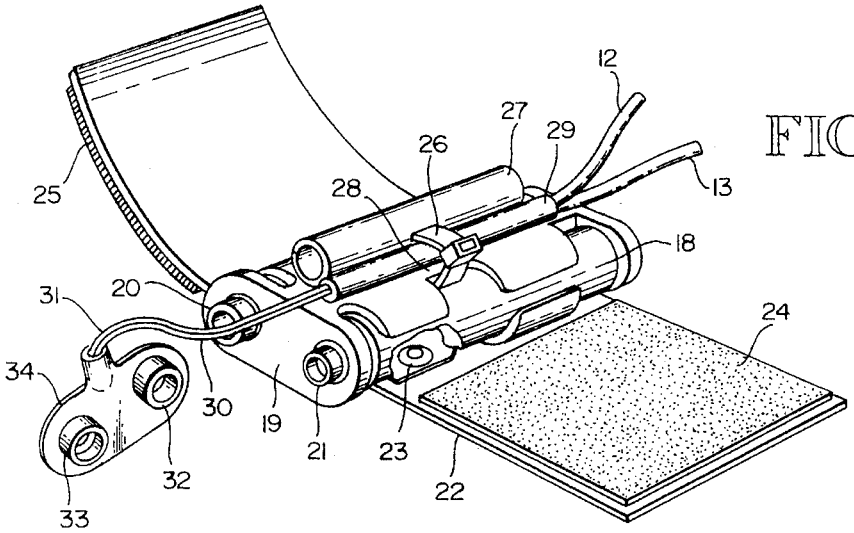
FIG. 2
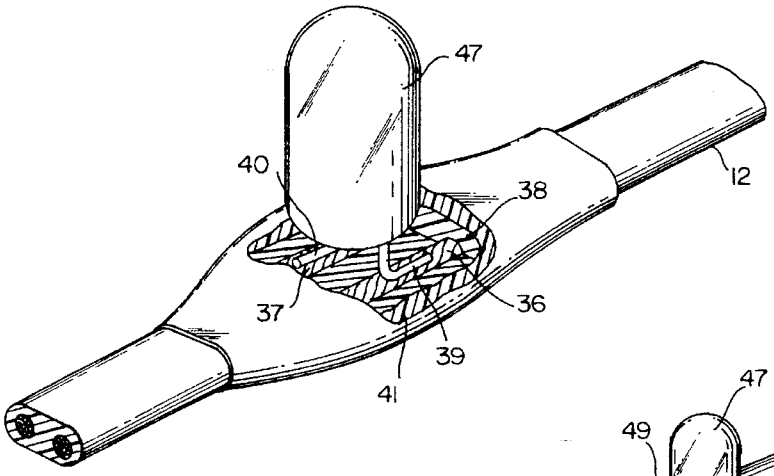
FIG. 3
FIG. 4
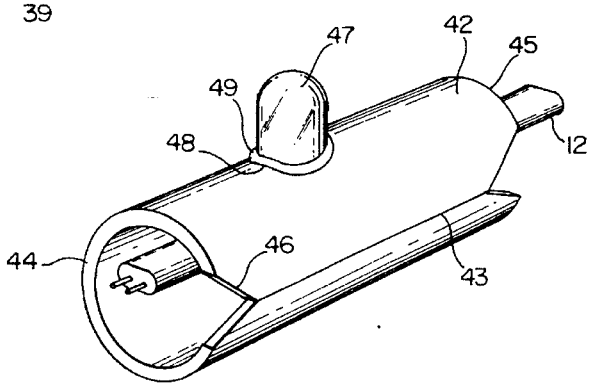

LIGHTING APPARATUS FOR USE ON KITES

BACKGROUND OF THE INVENTION

1. Field

The subject invention is in the fields of lighting apparatus in which there is a plurality of lights distributed along the conductors which provide power to the lights. More particularly, it is in the field of such apparatus which is battery powered and, still more particularly, detachably attachable to kites.

2. Prior Art

It is a long standing and well known practice to attach a light or lights to kites for both aesthetic and practical purposes, particularly for signaling. However, the upsurge of interest in kites and fairly recent improvements in design and technology have brought about increased interest in attaching lights to kites for aesthetic purposes. One lighting apparatus known to be made commercially available in response to that interest comprises a long narrow strip of printed circuit board, a plurality of light emitting diodes (LED's) attached to the circuit on the board, a length of two-wire flexible conductor, a terminal board for a battery pack and the battery pack and batteries. The circuit board and the battery pack are fastened to structure of the kite with tape or tie strips and interconnected by the flexible conductor and the terminal board. In this apparatus the battery pack is a loose part and there is no flexibility in the arrangement of the lights on the kite. Also, the use of tape and ties requires time and also considerable skill in order to make the attachments adequately secure but not cumbersome or unduly difficult to remove.

A second apparatus known to be commercially available comprises a battery pack, a terminal board for the battery pack, a length of two-wire flexible conductor, a connector between this flexible conductor and a pair of two-wire flexible conductors and two pluralities of plastic clips and light emitting diodes, one plurality being used on one of the pair of conductors and the other plurality on the other. The clips are used to fasten the LED's and the conductors to the kite structure. This apparatus allows more flexibility in the arrangement of the lights; however, the conductors are small gauge ribbon cable (to save weight), the lights and clip are not firmly interconnected, either tape or tie wrap is needed to attach the battery pack to the structure and the battery pack is a loose part.

Accordingly, the primary objective of the subject invention is to provide lighting apparatus for kites, apparatus in which there are no loose parts, there is flexibility in the arrangement of the lights, there is no requirement for taping components in place, and the lights and the parts used to attach them to kite structure are easily and securely attached to each other and to the structure.

SUMMARY OF THE INVENTION

The subject invention is a lighting apparatus for use on kites. The apparatus comprises a battery pack including some electronic components, two insulated two-wire conductors connected to the battery pack, two pluralities of light emitting diodes (also termed lights and LED's for purposes of this disclosure), one plurality connected to one conductor at points along the conductor and the other plurality connected to the other conductor at points along the length of that conductor.

The battery pack comprises a commercially available battery holder having a positive terminal and a negative terminal at one of its ends, a strap attached to the holder and having Velcro (T.M.) components for attaching the ends of the strap to each other, and a heat shrunk elastomeric tube enclosing the connections of the two conductors to resistors and connections of the resistors to conductors leading to a terminal strip which has terminals which detachably attach to the terminals on the battery holder. The battery pack also includes a length of elastomeric tubing. This tubing and the heat shrunk elastomeric tube and its contents are attached to the holder by a plastic tie strap. The purpose of the length of elastomeric tubing is to provide friction to inhibit relative motion between the battery pack and kite structure to which the battery pack is attached by wrapping the strap with Velcro (T.M.) components around the pack contents and the structure, the strap being held closed by the Velcro (T.M.) components.

Each LED is attached by (1) clearing a patch of insulation from the two-wire conductor at the point of attachment, (2) soldering the leads of the LED, one to each conductor and (3) covering the exposed wires, the leads and the soldered connections with a coating of self curing flexible plastic.

Each clip is made from a length of thick walled plastic tubing about 1.5 inches long and 0.5 inches in diameter and having a 1/16 inch wall thickness. The tubing is slit lengthwise at one point of its circumference and the ends of the slit are chamfered on both sides with ¼ inch chamfers. There is a round hole through the tubing wall at its mid length point and at 90° to the slit. Each clip is unwrapped so that it can be placed over the light emitting end of a LED. A bead of adhesive is laid around the LED in contact with the tubing. When this adhesive cures it inhibits removal of the clip from the LED but disassembly is possible because of the flexibility of the tubing. A clip is assembled onto each LED.

To install the light apparatus on a kite the battery pack is strapped onto one of the rod-like pieces of the kite structure and the two-wire conductors with LED's attached are normally attached to the rod-like kite structure which forms the leading edge of the kite. The lights are turned on by snapping the terminals on the terminal board onto the terminals on the battery holder The lights are turned off by removing the terminal board.

The invention is described in more detail below, with reference to the attached drawings.

BRIEF DESCRIPTION OF THE DRAWINGS

FIG. 1 is a general view of the subject apparatus installed on a kite and viewed from behind the kite.

FIG. 2 is a perspective view showing details of the battery pack.

FIG. 3 is a perspective view of a LED installed on a two-wire conductor.

FIG. 4 is the same as FIG. 3 except that a clip is installed on the LED and around the conductor ready to hold the LED and conductor onto the kite.

DETAILED DESCRIPTION OF THE INVENTION

The subject invention is lighting apparatus for use on kites and is shown in FIG. 1 installed on a kite. The kite is being viewed from behind. The apparatus comprises a battery pack 10 attached to structure 11 termed the spine of the kite. Two-wire insulated conductors 12 and 13 extend up the spine and along structure termed spars 14 and 15 which are covered by the fabric 16 of the kite. Clips, clip 17 being typical, attach the conductors and LED's at points along the spars, the LED's not being visible in this view since they direct their light from the front of the kite.

FIG. 2 illustrates details of the battery pack. The pack in this embodiment holds two batteries, side-by-side with battery 18 visible in this view. The batteries are held in holder 19. The holder is a commercially available assembly and includes conductors which connect the batteries in series and connect them to terminals 20 and 21. Strap 22 is attached to the holder by rivets, rivet 23, visible in the cutaway of the battery, being typical. Patches of Velcro (T.M.) fastening are attached to the strap, portion 24 being the hook portion and portion 25, on the other side and end of the strap, being the loop portion. Tie strap 26 is threaded through two punctures in an elastomeric component such as tube 27, around portion 28 of the holder and around shrink tube 29 to hold tubes 27 and 29 onto the holder. Tube 29 covers the connections between the wires in conductors 12 and 13, leads 30 and 31 and resistors which limit the power delivered to levels acceptable by the LED's Leads 30 and 31 are connected to terminals 32 and 33 on terminal board 34. Terminals 32 and 33 snap onto terminals 20 and 21 on the holder to provide battery power to the LED's.

FIG. 3 illustrates the attachment of an LED 35 to wires 36 and 37 in conductor 12. A small portion of insulation 38 is removed to expose the wires and lead 39 of the LED is soldered to wire 36 and the other LED lead 40 is soldered to wire 37. The entire attachment is then coated with self curing flexible material 41, part of which is shown cut away to show the soldered connections.

In FIG. 4 clip 42 has been installed on the LED and conductor of FIG. 3. The clip is a length of stiff but flexible plastic tubing. Slit 43 extends from end 44 to end 45 of the clip, parallel to the longitudinal axis of the tube. The junctures of the slit with the ends are chamfered, chamfer 46 being typical. The lighted end 47 of the LED is inserted through hole 48 in the clip. The center of the hole is 90° radially from the slit and the hole diameter and the diameter of the LED are essentially equal. A bead of adhesive 49 is laid around the LED at the surface of the tubing. The adhesive adheres to the LED but not the tubing and serves to retain the LED in the tubing; however, the LED can be removed from the clip because the flexibility of the tubing material allows the bead of adhesive to be forced through the hole. In use the chamfers at the ends of the slit facilitate spreading the clip so that the slit is widened to allow the clip to close around a spar (or a fabric covered spar) to hold the clip, LED and conductor on the spar. The 90° angle between the slit and the hole for the LED assures that the LED is directed essentially perpendicularly to the front face of the kite.

It is considered to be understandable from this description that the subject invention meets its objectives. It provides apparatus for use on kites, apparatus which has no loose parts, is easily and securely attached to the kite with flexibility in the placement of the lights and with no requirement for taping components in place.

It is also considered to be understood that while one embodiment of the invention is described herein, other embodiments and modifications of the one described are possible within the scope of the invention which is limited only by the attached claims.

I claim:

1. Light apparatus for use on a kite having structure, said apparatus comprising:

a battery pack, comprising at least one battery, at least one two-wire insulated conductor having a length, a plurality of light emitting diodes, each of said diodes having a light emitting end having a first diameter, said diodes being electrically and physically connected to said at least one conductor at points spaced along said length, said conductor being electrically connected to said battery and physically connected to said battery pack, said apparatus further comprising means for attaching said battery pack to said structure and a plurality of means for attaching each of said plurality of light emitting diodes to said structure, each of said plurality of means for attaching said light emitting diodes to said structure comprising a piece of tubing having a length, a longitudinal axis, a wall and a first end and a second end and having a slit from said first end to said second end parallel to said longitudinal axis, said tube also having a hole through said wall at a mid point of said length and 90° radially displaced from said slit, said hole having a second diameter essentially equal to said first diameter, said means for attaching said light emitting diode being installed on said light emitting diode by inserting said light emitting diode through said hole and laying a bead of adhesive around said lighting emitting diode such that said bead inhibits removing said light emitting diode from said means for attaching said light emitting diode.

2. The apparatus of claim 1 in which said battery pack further comprises an elastomeric component which frictionally inhibits relative motion between said pack and said structure to which said pack is attached.

* * * * *